US005616049A

United States Patent [19]

Schwäger et al.

[11] Patent Number: 5,616,049

[45] Date of Patent: Apr. 1, 1997

[54] CONNECTOR ASSEMBLY FOR METAL-JACKETED LAMBDA PROBE CONDUCTOR

[75] Inventors: Michael Schwäger, Mörfelden; Jürgen Ryll, Egelsbach; Lutz Wittig, Langen, all of Germany

[73] Assignee: The Whitaker Corporation, Wilmington, Del.

[21] Appl. No.: 402,448

[22] Filed: Mar. 13, 1995

[30] Foreign Application Priority Data

Mar. 24, 1994 [GB] United Kingdom ..... 9405845

[51] Int. Cl.[6] ..... H01R 13/516

[52] U.S. Cl. ..... 439/455; 439/589

[58] Field of Search ..... 439/453, 454, 439/455, 589, 599, 610

[56] References Cited

U.S. PATENT DOCUMENTS 1,960,938 5/1934 Forbes ..... 439/610

2,226,610 12/1940 Heyman ..... 439/455

4,990,103 2/1991 Sazaki et al. ..... 439/455

*Primary Examiner*—Neil Abrams

*Attorney, Agent, or Firm*—Driscoll A. Nina

[57] ABSTRACT

A connector assembly (10) for connection to a high temperature conductor (2) comprises a metallic retention member (12) welded to the metallic jacket of the conductor (2). The retention member (12) comprising an anti-rotation section (82) cooperable with an outer shell (20) of the connector assembly to securely hold and prevent rotation of wires (6) of the conductor (2) making electrical contact with each other or the metallic jacket (4). The provision of the retention member (12) cooperating with the connector housing shell (25) ensures that a reliable, rigid and sealed connection is provided between the high temperature conductor (2) and a complementary connector (56). The anti-rotation section (82) can be formed with a hexagonal profile to be fitted into a complementary recess of the outer shell (25) to provide the anti-rotation feature.

19 Claims, 2 Drawing Sheets

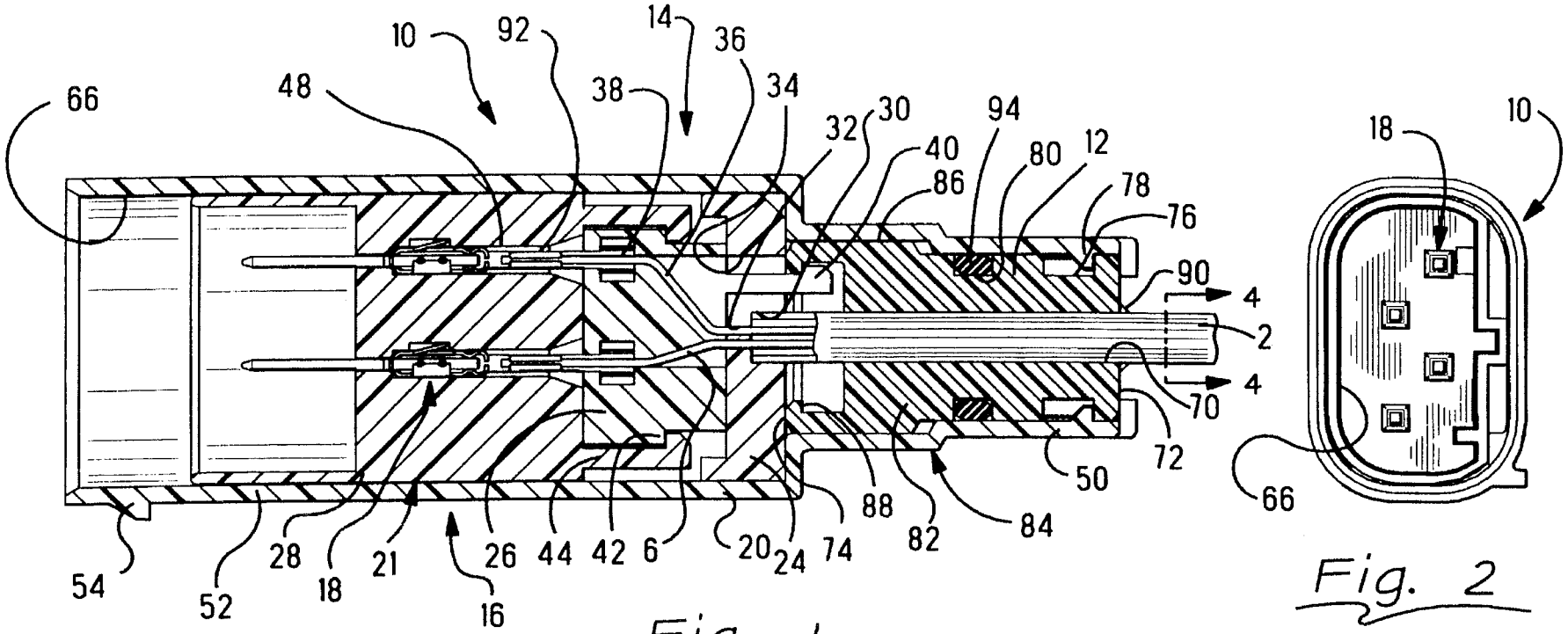
Fig. 2
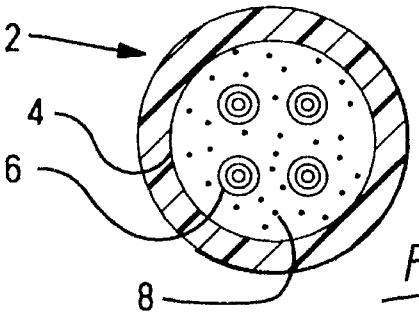
Fig. 4
Fig. 1
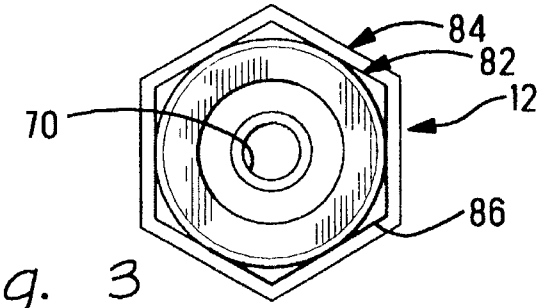
Fig. 3

CONNECTOR ASSEMBLY FOR METAL-JACKETED LAMBDA PROBE CONDUCTOR

BACKGROUND OF THE INVENTION

1. Field of the Invention

This invention relates to an electrical connector assembly for secure mounting to a lambda probe conductor.

2. Description of the Prior Art

Lambda probes are positioned within the exhaust gas path of automobiles to measure various parameters thereof, in particular in conjunction with the installation of a catalytic converter. Due to the extremely high temperatures of the exhaust gases, the lambda probe typically consists of a ceramic substrate with electrical circuit traces thereon which are connected to a high temperature resistant conductor. This high temperature resistant lambda probe conductor could consist of an outer metallic jacket filled with a high temperature resistant electrically insulative material such as magnesium oxide within which are positioned high temperature resistant metallic conducting wires. The conducting wires must obviously be held apart from each other and from the outer metallic jacket by the insulator.

The conductor is made as short as possible as it is relatively unflexible and very costly, but nevertheless needs a sufficient length such that the free end has a low enough temperature for connection to a conventional connector and low temperature conducting wires (i.e. such as copper strands with a plastic insulative jacket). One of the problems, however, is to ensure that the wires of the lambda probe conductor are securely held apart to avoid short circuiting therebetween, in particular by preventing rotation or uncontrolled bending of the conducting wires with respect to each other and to the outer metallic jacket. It would also be desirable to provide a cost-effective connector assembly for the lambda probe connector, that can be produced in an automated procedure and that allows simple connection of conventional low temperature conducting wires thereto. Provision of a secure connector at the end of the lambda probe conductor, also allows easy removal, maintenance and repair of the lambda probe.

SUMMARY OF THE INVENTION

It is therefore an object of this invention to provide an electrical connector for a high temperature conductor that allows rapid connection and disconnection to conventional conductors.

It is a further object of this invention to provide an electrical connector for mounting to a rigid high temperature resistant conductor, that is reliable, cost-effective and provides sealing means therebetween.

The objects of this invention have been achieved by providing a connector assembly for a high temperature resistant conductor, the conductor having an outer metal jacket surrounding a plurality of conducting wires and a high temperature resistant insulative material separating the conductors from each other and from the outer metal jacket, characterized in that the connector assembly comprises a retention member rigidly attached to the outer jacket of the lambda probe conductor, and a main connector section attached to the retention member in an unrotatable manner, the connector section comprising terminals therein for connection to the conducting wires of the high temperature conductor. In a preferred embodiment, the retention member is a metallic part welded (or brazed) to the lambda conductor jacket, having a means for latching a housing of the connector section thereto, and a means for receiving a seal therebetween.

BRIEF DESCRIPTION OF THE DRAWINGS

FIG. 1 is a cross-sectional view through a connector assembly mounted to a lambda probe conductor;

FIG. 2 is a view in the direction of arrow 2 of FIG. 1;

FIG. 3 is an end view of a retention member;

FIG. 4 is a cross-sectional view through a high temperature resistant conductor;

DETAILED DESCRIPTION OF THE PREFERRED EMBODIMENT

Figure 6:
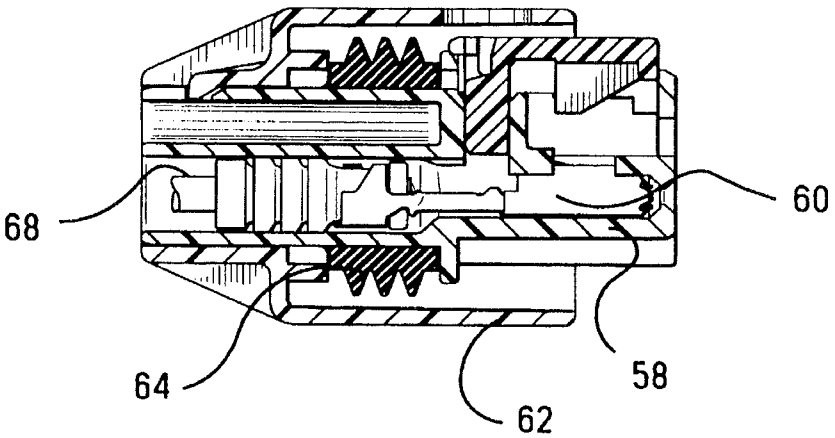
FIG. 6 is a cross-sectional view along the lines 6—6 of FIG. 5.
Figure 5:
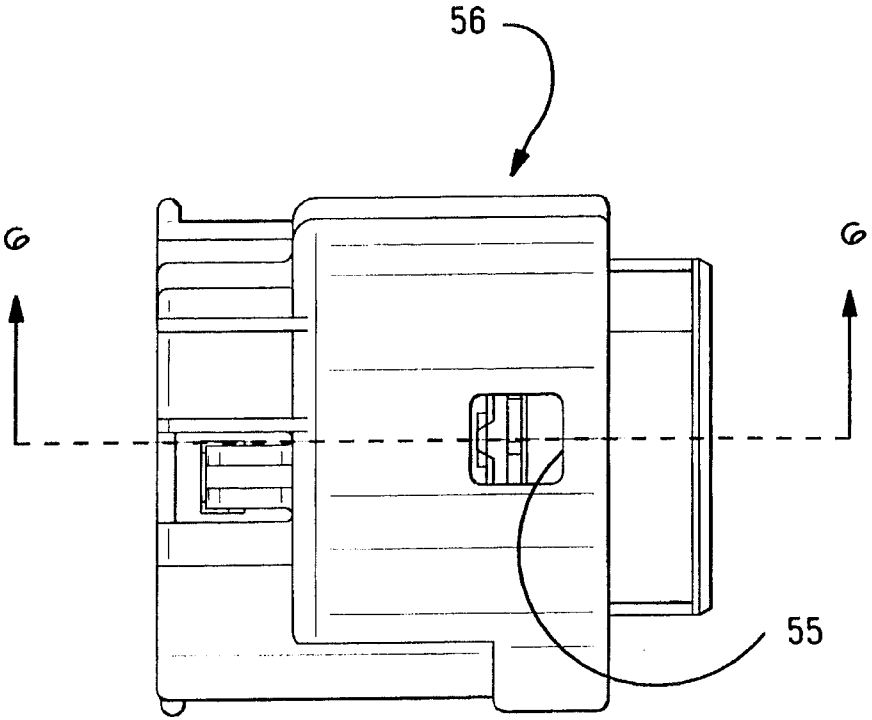
FIG. 5 is a view of a complementary connector for coupling to the connector of FIG. 1.

Referring first to FIG. 4, a high temperature conductor 2 is shown comprising an outer metallic jacket 4 and a plurality of conducting wires 6 positioned therein, the conducting wires 6 and metallic jacket 4 being separated from one another by a high temperature insulative material 8 such as magnesium oxide (MgO). The conductor 2 is connected at one end, the hot end, to a lambda probe (not shown) projecting into an automobile exhaust pipe (not shown) for measuring certain parameters of the exhaust gases which can attain temperatures over 900° C. The conductor 2 is led away from the exhaust pipe to the cold end. Due to the cost of the high temperature conductor 2, and also to it's relatively high rigidity, it is desirable to have the conductor short as possible. The "cold end" is therefore situated at around 100°–120° C. which some insulative plastic connector housings can withstand. The conducting wires 6 do not have individual insulative layers similar to conventional low temperature copper conducting wires with a plastic insulative jacket, as flexible materials such as plastic cannot be used at these temperatures, high temperature insulating material usually being relatively brittle or fragile. There is therefore a need to connect the conducting wires 6 to a connector that maintains the conducting wires securely apart from each other and from the outer metal jacket 4. The latter is achieved by the connector assembly as described below.

Referring now to FIG. 1, an electrical connector assembly 10 comprises a retention member 12 and a connector section 14 comprising a housing 16 and terminals 18 mounted therein for connection to the wires 6. The housing 16 comprises an outer housing shell 20 and an inner housing 21 split into three separate sections: a wire receiving section 24, an intermediate section 26, and a mating end section 28 securely receiving the terminals 18 therein. The conductor receiving section 24 comprises a conductor end receiving recess 30 that extends into smaller diameter cavities 32 allowing passage of the conducting wires 6 therethrough to the intermediate housing 26. The conductor receiving section 24 further comprises through-holes 34 for allowing latching means of the housing to pass therethrough. The intermediate housing 26 comprises wire receiving channels 36 that extend from a wire receiving end to a mating end, for holding apart and guiding the conducting wires 6 into terminal receiving cavities 38 that extend to the mating end of the intermediate housing 26. The intermediate housing 26 further comprises latching arms 40 for latching onto the retention member 12. The intermediate housing 26 also comprises latching shoulders 42 for cooperation with latches 44 of the mating end housing section 28 for retention thereof. The mating end housing section 28 comprises terminal receiving cavities 48 for securely receiving the terminals 18 therein, the cavities 48 aligned with the terminal receiving cavities 38 of the intermediate housing section 26.

The outer housing shell 20 comprises a retention member section 50 and a larger inner housing guiding section 52 having latching means 54 cooperable with latching means 55 of a complementary connector 56. The connector 56 comprises a housing 58 having terminals 60 for mating with the terminals 18. The complementary connector further comprises an outer shroud 62 insertable over the inner housing section 52 of the outer shell, whereby a peripheral seal 64 mounted around the housing 58 engages an inner surface 66 of the shell 20 for sealing between the connector assemblies 10, 56. The terminals 60 of the complementary connector assembly 56 are connected to conventional low temperature conducting wires 68 which lead to electronic components that analyze the electronic signals of the lambda probe.

The retention member 12 is a machined metallic part, principally turned, comprising a central conductor receiving bore 70 extending from a conductor receiving end 72 to a connector assembly receiving end 74, a retention recess 76 cooperable with latching protrusions 78 of the outer housing 50, a sealing groove 80 for receiving a sealing ring therein engageable against the outer housing 50 for sealing therebetween, and an anti-rotation section 82 cooperable with an anti-rotation section 84 of the outer housing 50 for preventing rotation of the housing 14 with respect to the retention member 12. As shown in FIG. 3, the outer periphery of the anti-rotation section 82 has a hexagonal profile 86. The retention member 12 further comprises retention shoulders 88 proximate the connector assembly end 74 for cooperation with the intermediate housing resilient latches 40 for secure fixing thereof.

The retention member 12 is rigidly fixed to the conductor 2 by welding ends 90 of the bore 70 to the jacket 4 of the conductor 2. The welding is effectuated around the whole periphery of the conductor to completely seal off the gap between the conductor 2 and the bore 70. One could of course also imagine other bonding methods such as brazing, or even glueing a retention member 12 to the conductor 2 if a suitable glue could be found that withstands the temperature and the mechanical solicitation (such as vibrations and thermal expansion) without being adversely effected. Welding or brazing provides a very strong and reliable means of attaching the retention member 12 to the connector section 10. One could however also imagine crimping the retention member 12 to the conductor 2.

Assembly of the connector assembly 10 is effectuated by first inserting the cold end of the conductor 2 through the outer housing shell 20, welding the retention member 12 to the conductor 2, inserting the wires 6 through the wire receiving housing section 24 and into the channels 36 of the intermediate housing 26 until the intermediate housing resilient latches 40 engage with the retention shoulders 88 of the retention member 12; then inserting a wire receiving end of the terminals 18 into the terminal receiving cavities 38 of the intermediate housing 26, the free end of the wires 6 simultaneously being inserted through connection portions 92 of the terminals 18, crimping the connection portions 92 to the conducting wires 6; and finally inserting the terminals 18 through the terminal receiving cavities 48 of the mating section housing 28 until the terminals 18 enter into latching engagement with the cavities 48 and the latching arms 44 engage with the latching shoulders 42 of the intermediate housing 26. The mating section housing 28 is thus securely fixed to the intermediate housing 26 which is in turn securely held to the retention member 12. The outer housing shell 20 can then be pulled over the retention member 12 and the inner housing 21 such that the anti-rotation sections 84, 86 engage and the elastomeric seal 94 is compressed between the seal recess 80 and outer housing shell for sealing therebetween. Engagement of the latch protrusions 78 and latch recess 76 ensures that the outer housing shell is securely held to the retention member 12.

The outer housing shell 25 is thus strongly held to the conductor 2 and thereby also providing strong support to the inner housing (and terminals) by snugly fitting thereover, for preventing rotational movement thereof, or any other movement that may allow the conductors 6 to contact each other or to break. The latter is also an important aspect because the conductors 6 are typically of single strand material that can break under cyclic bending due to vibrations, this being avoided by the rigid and secure structure of the connector assembly as described above. Furthermore, due to the provision of the retention member 12 rigidly attached to the conductor 2, the housing parts 14 can be made relatively inexpensively from injection moulded plastic yet sufficiently rigidly held to the high temperature conductor 2. Furthermore, provision of the retention member 12 also provides a reliable sealing means between the conductor 2 and connector assembly 10.

Advantageously therefore, a strong and reliable connection is provided for interconnecting a high temperature resistant conductor 2 to conventional low temperature conductor 68 whilst allowing repeated connection and disconnection in a cost-effective, reliable and sealed manner.

We claim:

1. A connector assembly for interconnecting a semi-rigid high temperature conductor (2) having an outer metal jacket (4) and wire conductors therein, to low temperature conductors, characterized in that the connector assembly (10) comprises a connection section (14) having a housing (16) with terminals (18) mounted therein for pluggable and unpluggable electric connection with a complementary low temperature connector (56), the assembly (10) further comprising a retention member (12) rigidly bonded to the metal jacket (4) and having latching members (88, 76) cooperable with housing latching members (40, 78) for secure assembly of housing (16) thereto, the retention member (12) and housing (16) having complementary anti-rotation sections (86, 84) cooperating to prevent rotation of the housing (16) with respect to the high temperature conductor (2), the housing further comprising an intermediate housing section (26) having wire receiving channels (36) therethrough extending from a face proximate an end of the metal jacket (6), the channels (36) guiding and separating the wire conductors to avoid contact between the wire conductors.

2. The connector assembly of claim 1 characterized in that the retention member (12) is welded to the metal jacket (4).

3. The connector assembly of claims 1 or 2 characterized in that the housing (16) comprises an outer housing shell (20) and a separate inner housing (21), the outer housing shell (20) having the anti-rotation section (84) cooperable with the retention member anti-rotation section (86).

4. The connector assembly of claim 1 characterized in that a seal (94) is provided between the retention member (12) and the housing (16) for sealing therebetween.

5. The connector assembly of claim 1 characterized in that the housing (16) comprises a mating-end housing section (28) separate from the intermediate housing section (26), the mating-end housing section (28) for securely receiving the terminals (18) therein, the mating-end housing section (28) having retention members (44) cooperable with the intermediate housing section (26) for secure retention of the mating-end housing section (28) thereto.

6. The connector assembly of claim 1 characterized in that the intermediate housing section (26) comprises latching members (40) cooperable with latching members (88) of the retention member (12) for securely retaining the intermediate housing section (26) to the retention member (12).

7. The connector assembly of claim 2 characterized in that the retention member's anti-rotation member comprises a hexagonal outer profile.

8. The connector assembly of claim 1 characterized in that the outer housing shell comprises a retention member section (50) and an inner housing guiding section (52) extending therefrom, the retention member section (50) mounted over the retention member (12), and the inner housing guiding section (52) mounted over the inner housing (21) and extending therebeyond to provide an inner sealing surface (66) for cooperation with sealing means (64) positioned between the surface (66) and the complementary connector (56).

9. The connector assembly of claim 7 characterized in that the inner housing guiding section (52) fits snugly over the inner housing (21), the inner housing and outer housing shell having cross-sectional profiles adapted to preventing rotational movement therebetween.

10. A connector assembly comprising a semi-rigid high temperature conductor (2) having a solid outer metal jacket (4) and bare wire conductors therein separated by a high temperature insulator, for connection to a low temperature connector wherein the connector assembly (10) comprises a connection section (14) having a housing (16) with terminals (18) mounted therein for pluggable and unpluggable electric connection to the low temperature connector (56), the assembly (10) further comprising a retention member (12) rigidly bonded to the metal jacket (4) and having latching members (88, 76) cooperable with housing latching members (40, 78) for secure assembly of housing (16) having complementary anti-rotation sections (86, 84) cooperating to prevent rotation of the housing (16) with respect to the high temperature conductor (2).

11. The connector assembly of claim 10 characterized in that the retention member (12) is welded to the metal jacket (4).

12. The connector assembly of claim 10 characterized in that the housing (16) comprises an outer housing shell (20) and a separate inner housing (21), the outer housing shell (20) having the anti-rotation section (84) cooperable with the retention member anti-rotation section (86).

13. The connector assembly of claim 10 characterized in that a seal (94) is provided between the retention member (12) and the housing (16) for sealing therebetween.

14. The connector assembly of claim 10 characterized in that the housing (16) comprises an intermediate housing section (26) having wire receiving channels (36) therethrough extending from a face proximate an end of the metal jacket (6), the channels (36) guiding and separating the wire conductors to avoid contact between the wire conductors.

15. The connector assembly of claim 14 characterized in that the housing (16) comprises a mating-end housing section (28) separate from the intermediate housing section (26), the mating-end housing section (28) for securely receiving the terminals (18) therein, the matingend housing section (28) having retention members (44) cooperable with the intermediate housing section (26) for secure retention of the mating-end housing section (28) thereto.

16. The connector assembly of claim 14 characterized in that the intermediate housing section (26) comprises latching members (40) cooperable with latching members (88) of the retention member (12) for securely retaining the intermediate housing section (26) to the retention member (12).

17. The connector assembly of claim 10 characterized in that the retention member's anti-rotation member comprises a hexagonal outer profile.

18. The connector assembly of claim 10 characterized in that the outer housing shell comprises a retention member section (50) and an inner housing guiding section (52) extending therefrom, the retention member section (50) mounted over the retention member (12), and the inner housing guiding section (52) mounted over the inner housing (21) and extending therebeyond to provide an inner sealing surface (66) for cooperation with sealing means (64) positioned between the surface (66) and the complementary connector (56).

19. The connector assembly of claim 18 characterized in that the inner housing guiding section (52) fits snugly over the inner housing (21), the inner housing and outer housing shell having cross-sectional profiles adapted to preventing rotational movement therebetween.

* * * * *